US012604941B2

(12) United States Patent
Mini Townson et al.

(10) Patent No.: US 12,604,941 B2
(45) Date of Patent: Apr. 21, 2026

(54) MULTIDIRECTIONAL PROTECTION NET WITH ANGLED STRAPS FOR ALL HELMETS WITH AN OUTER SHELL

(71) Applicant: Titon Ideas Inc., Provincia de Panamá (PA)

(72) Inventors: Juan Mini Townson, Guatemala City (GT); Juan Alfaro Samayoa, Guatemala City (GT); Ana Morataya Urizar, Mixco (GT); Natalia Lima Ramírez, Guatemala City (GT); Ricardo Paz Cerezo, Mixco (GT); Jonathan Pu Aguilera, San Miguel Petapa (GT); Daniel Montenegro Berganza, San José Pinula (GT); César Saavedra Monterroso, Santa Catarina Pinula (GT)

( * ) Notice: Subject to any disclaimer, the term of this patent is extended or adjusted under 35 U.S.C. 154(b) by 0 days.

(21) Appl. No.: 19/358,106

(22) Filed: Oct. 14, 2025

(65) Prior Publication Data

US 2026/0101954 A1 Apr. 16, 2026

Related U.S. Application Data

(63) Continuation of application No. 19/276,205, filed on Jul. 22, 2025.

(60) Provisional application No. 63/707,626, filed on Oct. 15, 2024.

(51) Int. Cl.
*A42B 3/14* (2006.01)

(52) U.S. Cl.
CPC ..... *A42B 3/142* (2013.01); *A42B 3/14* (2013.01); *A42B 3/145* (2013.01); *A42B 3/147* (2013.01)

(58) Field of Classification Search
CPC ..... A42B 3/142; A42B 3/14; A42B 3/145; A42B 3/147
See application file for complete search history.

(56) References Cited

U.S. PATENT DOCUMENTS

| | | | | | |
|---|---|---|---|---|---|
| 2,679,046 | A * | 5/1954 | Dye | A42B 3/14 | 2/416 |
| 2,892,194 | A * | 6/1959 | Lee | A42B 3/14 | 2/416 |
| 3,221,340 | A * | 12/1965 | Joffe | A42B 3/14 | 2/417 |
| 3,714,668 | A * | 2/1973 | Mirabella | A42B 3/145 | 2/419 |

(Continued)

FOREIGN PATENT DOCUMENTS

AU 2006100989 A4 12/2006

*Primary Examiner* — Khaled Annis
(74) *Attorney, Agent, or Firm* — Eugenio J. Torres-Oyola; Victor M. Rodriguez-Reyes; Rafael Rodriguez-Muriel

(57) ABSTRACT

A helmet suspension system featuring angled straps acting as chords between points on a circular strap barrier or helmet shell, avoiding a central node to enable immediate response to lateral impacts. The system includes a fixed, non-adjustable net integrated with the circular strap barrier for stable head retention without manual adjustment. Straps with distinct tensile strengths, optionally combined with elastomeric components, enhance energy absorption and force distribution across the helmet shell. The design is lightweight, simple, and improves ventilation and comfort without bulky pads or complex mechanisms.

9 Claims, 12 Drawing Sheets

(56) References Cited

U.S. PATENT DOCUMENTS

| | | | | | |
|---|---|---|---|---|---|
| 3,897,596 | A | * | 8/1975 | Aileo | A42B 3/14 2/420 |
| 4,056,852 | A | * | 11/1977 | Greendale | A42B 3/145 2/909 |
| 5,628,071 | A | | 5/1997 | Nezer | |

* cited by examiner

MULTIDIRECTIONAL PROTECTION NET WITH ANGLED STRAPS FOR ALL HELMETS WITH AN OUTER SHELL

RELATED APPLICATIONS

This application is a continuation of U.S. application Ser. No. 19/276,205, titled "Multidirectional Protection Net With Angled Straps For All Helmets With An Outer Shell" and filed on Jul. 22, 2025, which claims priority to U.S. Provisional Application No. 63/707,626, titled "Multidirectional Impact Protection Suspension System For Helmets And Method Of Making The Same", filed Oct. 15, 2024, all of which are incorporated herein by reference in their entirety.

TECHNICAL FIELD

The subject disclosure relates to a multidirectional protection net with angled straps designed to absorb and dissipate impact energy, particularly lateral impacts, through a fixed, non-adjustable net of angled straps acting as chords, anchored to a flexible circular strap barrier formed by a single strap or continuous arrangement of pliable straps, optionally with hangers. The system provides multidirectional protection, enhanced comfort, ventilation, and compatibility with retention systems for all helmets with an outer shell, including but not limited to military, sports, industrial, safety, and motorcycle helmets.

BACKGROUND

Helmet suspension systems have long been developed to enhance user safety by providing a buffer between the head and the outer shell, distributing impact forces and improving comfort. Traditional systems, such as those found in the M1 military helmet, typically employ folded or slack straps that converge at a central intersection node. More recent designs, including four-point and six-point suspensions, often utilize adjustment mechanisms or intersecting strap geometries that prioritize vertical impact absorption. However, these conventional designs tend to exhibit limitations in addressing non-vertical impacts, particularly lateral forces, due to delayed tensile engagement resulting from initial slack, misalignment, or reliance on centralized strap nodes.

The inventors are familiar with various prior art helmet suspension designs, including those disclosed in U.S. Pat. No. 2,573,250 A (1951), U.S. Pat. No. 2,679,046 A (1954), U.S. Pat. No. 4,056,852 A (1976), U.S. Pat. No. 2,758,306 A (1954), U.S. Pat. No. 6,081,931A (1998), U.S. Pat. No. 2,769,176 A (1954), U.S. Pat. No. 2,814,043 A (1954), U.S. Pat. No. 3,110,900 A (1962), U.S. Pub. No. 2016/0192727 A1 (2016), and Int'l. App. No. PCT/IB2023/057514 (2023). While these systems introduce improvements in fit, adjustability, and impact resistance, they often share design characteristics-such as intersecting strap nodes, variable slack under dynamic loads, and reliance on comfort pads—that compromise performance under multidirectional impact conditions and add unnecessary bulk or complexity.

In contrast, the subject disclosure provides a novel and non-obvious suspension system designed to address the limitations of the prior art through: (1) angled straps acting as chords between two points on the circular strap barrier's or helmet shell's inner circumference, without passing through a central node, and pre-aligned to respond immediately to lateral impacts; (2) a fixed, non-adjustable net integrated with a circular strap barrier to secure the head without the need for manual adjustment; (3) the optional combination of straps with distinct tensile properties and optional elastomeric components to maximize energy absorption and distribute forces efficiently with the helmet shell; and (4) a simplified and lightweight design that improves ventilation and comfort without the use of bulky pads or complex mechanical parts.

Accordingly, the disclosed system represents an inventive step in the field of helmet suspension assemblies, improving multidirectional protection, enhancing user comfort, and reducing design complexity in a manner not suggested or taught by the known prior art

SUMMARY OF THE DISCLOSURE

The subject disclosure relates to a multidirectional protection net with angled straps for all helmets with an outer shell, including military, sports, industrial, safety, and motorcycle helmets, featuring a flexible circular strap barrier formed by a single strap or continuous arrangement of pliable straps, optionally with hangers, to which angled straps are attached, forming arches with only one face contacting the head. The angled straps, acting as chords connecting two points on the circular strap barrier's circumference or helmet shell's inner circumference without passing through the central intersection node, work with the circular strap barrier to provide a tridimensional hold, optimizing immediate tensile response for lateral impact resistance and energy absorption through strap deformation, shell deformation, optional elastomeric deformation, and optional impact-absorbing components. Unlike conventional suspensions (e.g., M1, 4-point, 6-point) with node-crossing straps that exhibit delayed tensile response due to slack or misalignment, the fixed, non-adjustable net ensures efficient energy dissipation. The net may combine straps with distinct tensile strengths (e.g., elastic or textile), forming engineered angled crossings below the apex of the head (e.g., at the forehead). The circular strap barrier and increased contact points enhance comfort and ventilation without comfort pads. The net is removable when using hangers, simpler and lighter than prior art, and compatible with retention systems (e.g., ratchet headbands, chin straps), which are not claimed.

The fixed non-adjustable net may optionally include: (i) elastomeric components integrated into angled straps or as connecting straps for enhanced energy dissipation; (ii) hangers with lateral slots for strap attachment and net removability; (iii) fixed attachment bars for permanent anchorage to the helmet shell; (iv) connecting straps linking angled straps or anchoring the net to the shell; (v) an impact-absorbing component (e.g., pads, inserts) to augment energy dissipation; (vi) adjustment features (e.g., adjustable headbands, chin straps, etc.) compatible with the fixed net to adapt to the wearer's head; (vii) straps with distinct tensile properties or elastomeric components to maximize energy absorption and distribute forces efficiently with the helmet shell.

Particularly, the subject disclosure relates to a multidirectional protection net for a helmet, comprising a circular strap barrier formed by at least one pliable strap, wherein the circular strap barrier is configured to encircle a wearer's head below an apex of the wearer's head; a plurality of angled straps each having a first face and a second face inverse to the first face, the plurality of angled straps forming arches with only one face contacting the wearer's head, each angled strap acting as a chord connecting two points on a circumference of the circular strap barrier's or on an inner circumference of a helmet shell without passing through a central intersection node, and oriented at an angle of 15-70° (alpha) relative to a horizontal plane defined by a longitudinal edge of the circular strap barrier; wherein the central intersection node is defined as a cylindrical volume extruded from a 1-2-inch diameter circle at a geometric center of an elliptical plane within the inner circumference of the helmet shell; wherein the circular strap barrier and the angled straps are configured to cooperatively provide a tridimensional hold that restricts head movement relative to the helmet shell during impacts by providing an immediate tensile response to enhance energy absorption through deformation of the straps and deformation of the helmet shell.

The subject disclosure also relates to a method of making a multidirectional protection net for a helmet, comprising providing a circular strap barrier formed by at least one pliable strap, the circular strap barrier configured to encircle the wearer's head below an apex of the wearer's head; attaching a plurality of angled straps to the circular strap barrier or a helmet shell via means of attachment, wherein each angled strap comprises a first face and a second face inverse to the first face, and wherein each angled strap forms an arch with only one face contacting the wearer's head and acting as a chord connecting two points on a circumference of the circular strap barrier or on an inner circumference of the helmet shell without passing through a central intersection node, each angled strap being oriented at an angle of 15-70° (alpha); wherein the circular strap barrier and the angled straps are configured to cooperatively provide a tridimensional hold that restricts relative movement of the wearer's head within the helmet during impacts by delivering an immediate tensile response The terms used herein shall have the meanings set forth in the Definitions section below, unless otherwise indicated by the context.

"Pliable Material": A substance that is flexible, bendable, and capable of being shaped or molded without breaking or losing its integrity. It can be easily manipulated, stretched, or deformed under force, including static forces like gravity, and often returns to its original shape or adapts to a new form depending on its properties. This includes any flexible material such as fabrics, textiles, polymers, elastomers, or composites, used in straps to form the circular strap barrier, angled straps, or connecting straps. These materials can conform to the user's head shape under static forces, bend through buckles, and be pulled tight without fraying or snapping. Common characteristics of pliable materials include: (1) Flexibility: ability to bend, twist, or fold without breaking; (2) Tensile Strength: capacity to withstand pulling forces, making it suitable for addressing impact energies; (3) Elasticity (in some cases): ability to stretch and return to its original shape (e.g., elastic straps); and (4) Durability: resistance to wear and tear despite repeated usage.

"Static Force": Naturally occurring forces on Earth, including but not limited to gravity, that cause a pliable strap to conform to or adapt its shape to the user's head under static loading, without additional external forces.

"Elastic Straps": Straps made of pliable materials with the ability to stretch and return to their original shape, including but not limited to rubber, silicone, or elastomeric polymers, configured to deform elastically during an impact event to dissipate energy within the crush zone, used as angled straps or connecting straps.

"Longitudinal Edge": The longitudinal edge of a strap refers to one of the two long, parallel boundaries L1, L2 that run along the length of a flat, elongated strap (as shown in FIG. 1*a*), defining its width. These edges are typically the outer perimeters of the strap's surface, distinguishing its lengthwise sides from its ends or cross-sectional boundaries (the first end and the second end of the strap). In the context of a pliable material like a textile strap, the longitudinal edge is critical for describing the strap's orientation, shape, and interaction with other components or surfaces. One of the longitudinal edges of a circular strap barrier is labeled Le1. This label is used to define the plane formed by the strap(s) in the circular configuration, providing a reference for the strap's spatial arrangement (e.g., horizontal, FIG. 1*b*). One of the longitudinal edges of an angled strap is labeled Le2. This strap is arched to fit the head of a user, and the labeled edge serves as a reference to define the plane formed by the strap (FIGS. 1*c*-1*e*). Additionally, Le2 is used to specify the angle at which the angled strap is positioned relative to the circular strap barrier.

"Arrangement": The deliberate organization, connection, or combination of straps (and optionally hangers) to form a continuous, perimeter-like structure around the head, functioning as a single structural unit, whether made from one continuous strap or multiple straps connected via hangers and means of attachment.

"Central Intersection Node": The three-dimensional cylindrical volume defined by the following: (i) identifying the largest horizontal elliptical plane (16) that lies flat within the inner circumference of a helmet shell at the base of the shell; (ii) locating the geometric center of that elliptical plane, which approximates the center of the helmet; and (iii) forming a circle centered at that geometric center with a diameter of approximately 1-2 inches (2.5-5 cm), then extruding the circle perpendicular to the elliptical plane (i.e., vertically upward) as a cylinder from the base plane to the top of the inner surface of the helmet shell (FIGS. 3*a*-3*b*). This volume approximates the region where conventional strap suspensions (e.g., 4- and 6-point suspensions' crossing straps) typically intersect at the helmet center, which the angled straps of the subject disclosure are configured to avoid. As used herein, the term "Central Intersection Node" may also be referred to as the "central node" or simply "node".

"Circular Strap Barrier": A single pliable strap or continuous arrangement of pliable straps, optionally including hangers, forming a flexible head ring encircling the head below the apex of the head (e.g., at the forehead), with longitudinal edge Le1 defining a horizontal plane (Hp, FIG. 1*b*), providing a tridimensional hold with angled straps.

"Angled Strap": A pliable strap forming an arch with only one face contacting the head, acting as a chord (a line segment connecting two points on the circular strap barrier's circumference or helmet shell's inner circumference without passing through the central intersection node), distinguishing from folded or node-crossing straps in conventional suspensions (e.g., M1, 4-point, 6-point). Angled straps are of two types: (1) connected directly to the circular strap barrier 13*a*, (2) connected to the helmet shell via hangers or attachment bars and to the net via a connecting strap and/or other angled straps, via a means of attachment 13*b*. A longitudinal edge is denoted Le2, oriented at a 15-70° angle (alpha) from the horizontal plane (Hp) defined by the longitudinal edge of a circular strap barrier (Le1, FIGS. 1*d*-1*e*).

"Connecting Straps": Straps used to stabilize and secure the net assembly (comprising angled straps and the circular strap barrier) and may carry loads but are always anchored to an angled strap or to the circular strap barrier, even when one end attaches to the helmet shell (FIGS. 11*a*-11*c*). Connecting straps are distinct from both angled straps and traditional crossing straps used in conventional 4- or 6-point helmet suspensions. Unlike angled straps, which avoid the central intersection node to fit the wearer's head, connecting straps may cross this node to maintain the net's cohesion. Unlike traditional crossing straps, which have both ends attached directly to the helmet shell (e.g., via hangers) to form the primary suspension structure and bear the primary load, connecting straps serve a secondary structural role. This configuration ensures that connecting straps, whether linking net components or attaching the net to the shell, maintain the structural integrity of the net assembly while clearly distinguishing their secondary role from the primary suspension function of traditional crossing straps.

"Net-Connecting Straps": These straps secure angled straps to each other, or to the circular strap barrier (20aI); or, secure multiple angled straps to each other and to the circular strap barrier (20aII), maintaining the configuration and integrity of the net assembly.

Example: A net-connecting strap may link one or more angled straps to each other or to the circular strap barrier, acting as a stabilizing component within the net (e.g., a central strap in FIGS. 11*a*-11*c*).

Distinction: These straps operate entirely within the net assembly, do not attach to the helmet shell, and focus on stabilizing the internal structure of the net.

"Shell-Connecting Straps": These straps (20*b*) connect the net assembly (specifically the circular strap barrier) to the helmet shell, via means of attachment and optionally via fixed attachment bars, providing secondary support and load-bearing capacity.

Example: A shell-connecting strap has one end attached to the circular strap barrier and the other to the helmet shell, bridging the net to the shell without forming the primary suspension (FIGS. 4*b*, 11*a*-11*c*).

Distinction: Unlike traditional crossing straps where both ends attach to the helmet shell to form the primary suspension, shell-connecting straps are anchored to the circular strap barrier at one end, integrating the net assembly with the shell.

"Net": A fixed, non-adjustable structure (or helmet suspension assembly) formed by the circular strap barrier, angled straps, and connecting straps (when applicable), providing a tridimensional hold to stop head movement toward the helmet shell during impacts, particularly lateral impacts, via immediate tensile response, maximizing the crush zone for energy absorption (FIGS. 5-11).

"Hanger": Any structures for attaching a strap to another strap, a helmet shell, and optionally to other suspension components, including but not limited to clips, buckles, guides, or connectors with multiple attachment points (e.g., lateral slots for constructing or guiding a circular strap barrier, or slots for more than two straps, FIGS. 2*a*-2*b*). Hangers form part of the circular strap barrier by connecting multiple straps 12, threading a single strap to form the barrier (similar to an adjustment buckle), or attaching angled straps 13 to the circular strap barrier via lateral or upper slots (14*a*), enabling net removability from the helmet. Hangers are also designed to create a distance between a circular strap barrier and the inner circumference of a helmet shell so as to allow for a crush zone 19 (see FIG. 4) to be available around the wearer's head. The hangers are distinguished from traditional hangers 18 that lack lateral slots for the circular strap barrier.

"Traditional Hanger": A conventional hanger currently used in most helmets to connect traditional crossing straps for traditional 4-point or 6-point suspensions or similar, and adjustment headbands to the helmet shell; and that lack lateral slots to secure straps to form a circular strap arrangement (see FIGS. 3*a*-3*b*).

"Attachment Bar": Any rigid structures permanently attached to a helmet shell, including but not limited to bars, rods, or plates secured by rivets, screws, welds, or similar, to helmet shells, that have the tensile capacity (ability to resist pulling forces) to withstand impact forces exerted by the net (the suspension assembly of straps within the helmet). Attachment bars are configured to anchor straps via wrapping, buckling, or other attachment methods, aiding in securing a permanent net by anchoring the circular strap barrier or the net, via angled straps or connecting straps, providing hold and stability to the wearer's head (see FIGS. 4*b*, 11*a*-11*c*).

"Traditional Crossing Strap": Conventional straps intersecting at the central intersection node 17 (see FIGS. 3*a*-3*b*), typically used in traditional four- and six-point suspensions, with both ends secured to the helmet shell, used in this document for comparison with angled and connecting straps.

"Elastomeric Component": Strips of elastomeric or elastic material (e.g., rubber, silicone) integrated into angled strap assemblies or configured as connecting straps, attached via means of attachment (e.g., sewing, overmolding), operating in tension to enhance energy absorption (FIGS. 8-10).

"Crush Zone": The open space between the head and the interior surface of a helmet shell. This space allows the helmet shell and/or suspension system to deform during an impact, preventing the wearer's head from making direct contact with the shell. By facilitating energy absorption through material deformation, the crush zone helps dissipate impact forces. In FIG. 4, this area is labeled to illustrate how the angled strap suspension's non-adjustable net provides a crush zone for energy dissipation (its size varies depending on helmet and suspension design).

"Impact-Absorbing Component": Any element, material, or structure (e.g., pads, inserts) integrated with the net to enhance energy dissipation during impacts, attached via means of attachment.

"Means of Attachment": Any method for securing straps to: other straps, elastomeric components, hangers, attachment bars, impact-absorbing components, or the helmet shell, including but not limited to sewing, ultrasonic welding, overmolding, injection molding, adhesives, buckling, mechanical interference, weaving, or mechanical fasteners.

"Retention Systems": Standard helmet components (e.g., ratchet headbands, chin straps, etc.) for securing the helmet to the head that are compatible with the net but not a part thereof.

"Alpha": Angles within a 15-70° range representing the orientation angle of angled straps relative to the circular strap barrier or helmet shell's inner circumference horizontal plane (Hp, FIGS. 1*d*-1*e*).

"Apex of the head": The highest point on the wearer's head, anatomically corresponding to the vertex or crown, typically located at the topmost point of the skull when the head is in an upright position. In the context of the helmet suspension assembly, the head apex serves as a reference point relative to the central intersection node 17, which is a cylindrical volume defined within the helmet shell. The head apex is generally positioned below or near the central intersection node's highest point on the inner surface of the helmet, and the angled straps 13, 13*a*, 13*b* and circular strap barrier 12 are configured to avoid direct pressure on this point, ensuring comfort and effective load distribution during impacts.

DETAILED DESCRIPTION OF THE DISCLOSURE

The helmet suspension assembly, designed for all helmets with an outer shell (e.g., military, sports, industrial, safety, motorcycle), comprises a flexible circular strap barrier 12 formed by a single strap or continuous arrangement of pliable straps, optionally with hangers 14, and angled straps 13, 13*a*, 13*b*, forming a fixed, non-adjustable net N1-7. Each angled strap comprises a longitudinal body having a first face F1 and a second face F2 inverse to the first face, a first end E1 and a second end E2 positioned distally from one another, and a first longitudinal edge L1 and an opposing second longitudinal edge L2, each extending from the first end E1 to the second end E2. The following embodiments describe distinct configurations of the net, each providing a tridimensional hold for lateral impact resistance via immediate tensile response, without designating any as preferred to maintain broad applicability. Each embodiment includes variations in materials (e.g., nylon, polyester, elastomers), strap widths (e.g., 2-3 cm), and attachment methods (e.g., sewing, buckling, attachment bars) to enable a person skilled in the art to practice the invention.

Figure 5A:
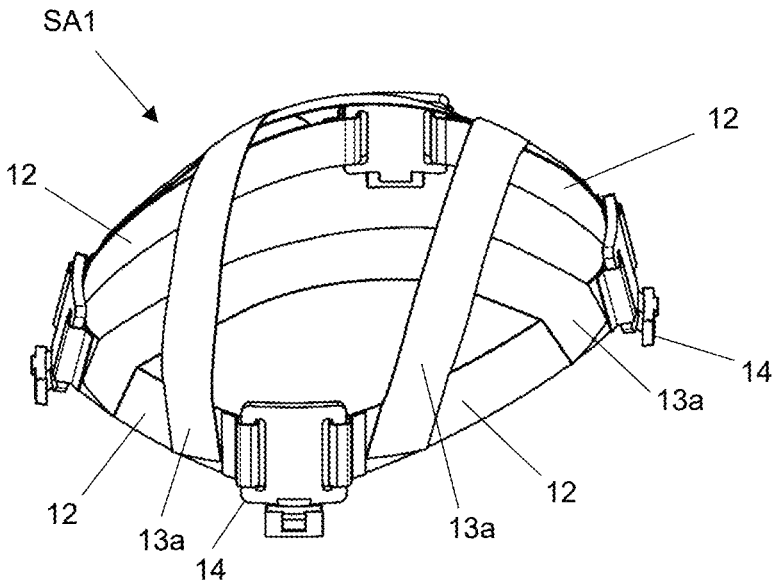
FIG. 5*a* shows an isometric view of a first embodiment of a helmet suspension assembly, illustrating a net configuration optimized for lateral impact resistance.
Figure 5B:
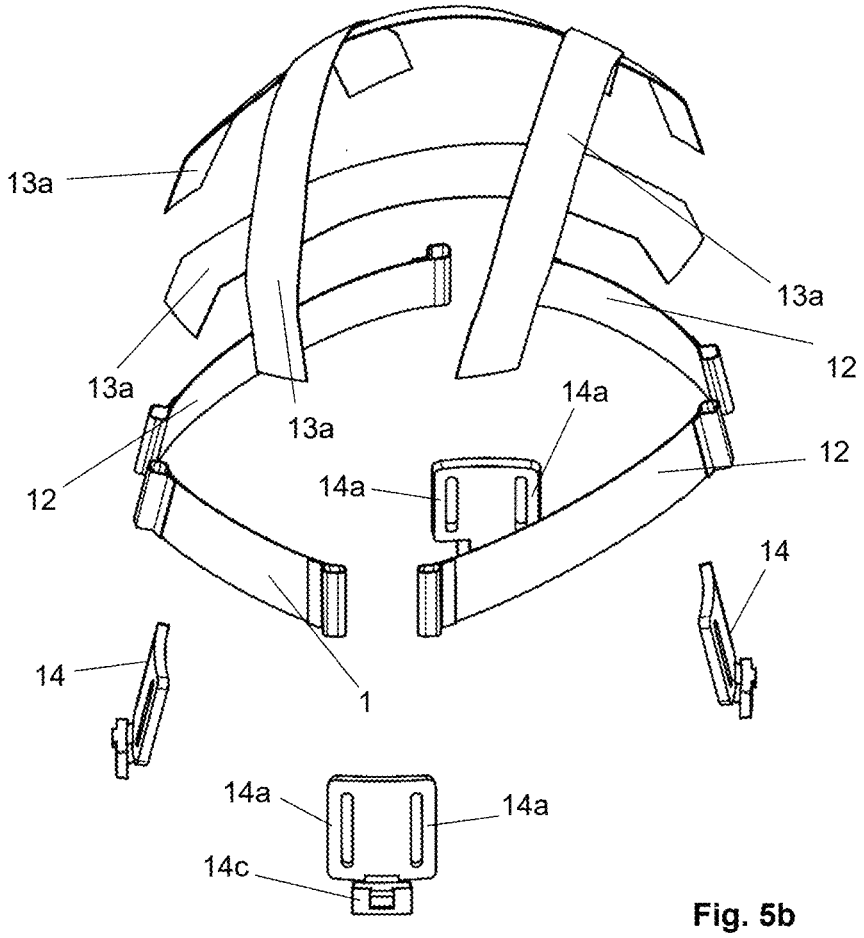
FIG. 5*b* shows an exploded isometric view of the helmet suspension assembly shown in FIG. 5*a*, illustrating the arrangement of components

Embodiment 1: Circular Strap Barrier Arrangement with 4 Crossing Angled Straps (FIGS. 5*a*-*b*)

This embodiment features a circular strap barrier 12 formed by multiple pliable straps made of materials such as nylon or polyester, each approximately 2-3 cm wide. These pliable straps are connected to the circular strap barrier 12 via hangers 14 with lateral slots 14*a* and encircle the head below the apex of the head, defined as a cylindrical volume extruded from a 1-2 inch diameter circle centered at the geometric midpoint of the helmet's inner circumference 16. Four angled straps 13*a*, made of pliable materials (e.g., nylon or elastomers, 2-3 cm wide), are attached directly to the circular strap barrier using appropriate means of attachment, such as sewing or buckling. Each angled strap forms an arch at an orientation angle (alpha) between 15° and 70°, with only one face contacting the head. These straps act as chords connecting two points on the circular strap barrier's circumference without passing through the central intersection node and intersect below the apex of the head (e.g., at the forehead) to form a fixed, non-adjustable net, as shown in FIGS. 5*a*-5*b*. This configuration defines net N1 for the present embodiment. Unlike traditional crossing straps 15 (see FIG. 3) anchored at both ends to the helmet shell via traditional hangers 18, the angled straps provide immediate tensile response to lateral impacts. FIG. 5*b* shows an exploded view of the component arrangement. The net N1 enhances head retention and energy absorption through strap and shell deformation, with variations including elastic straps or direct stitching to the barrier.

Figure 6A:
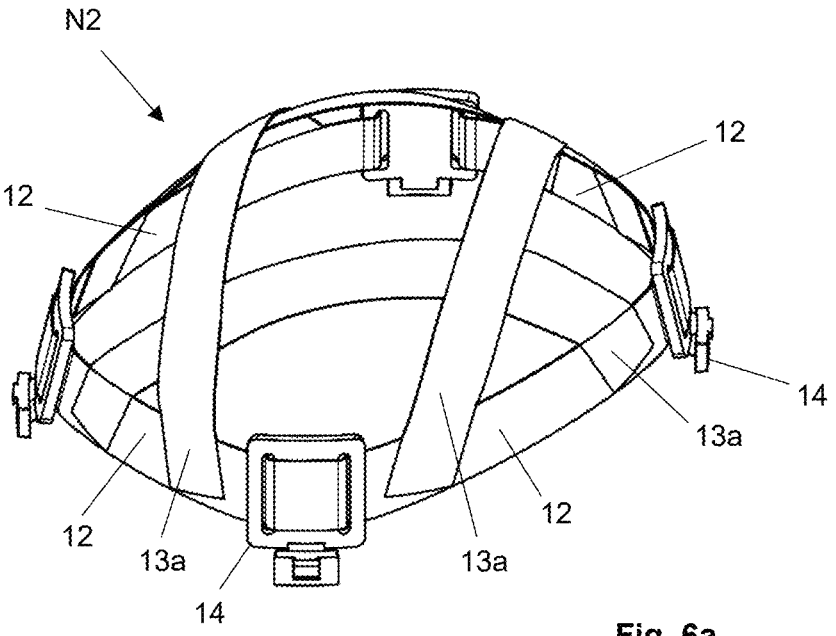
FIG. 6*a* shows an isometric view of a second embodiment of the helmet suspension assembly, illustrating a net configuration optimized for lateral impact resistance using a single strap for the circular strap barrier.
Figure 6B:
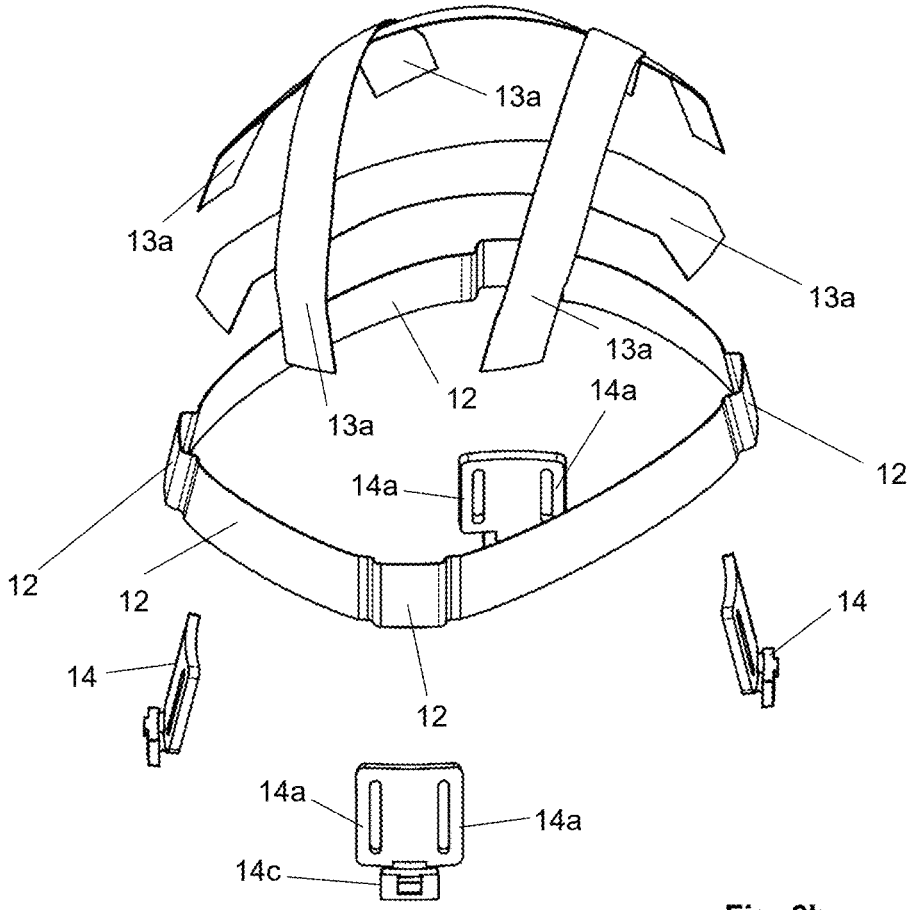
FIG. 6*b* shows an exploded isometric view of the helmet suspension assembly shown in FIG. 6*a*, illustrating the arrangement of components.

Embodiment 2: Circular Strap Barrier with Single Strap and 4 Crossing Angled Straps (FIGS. 6*a-b*)

This embodiment features a circular strap barrier 12 formed by a single pliable strap, made of materials such as nylon or polyester, with a width of approximately 2-3 cm. The strap is threaded through hangers 14 configured as buckle-like guides with lateral slots 14*a* and encircles the head below the apex of the head. Four angled straps 13*a*, made of pliable materials (e.g., nylon or elastomers, 2-3 cm wide), are attached directly to the circular strap barrier using suitable means of attachment, such as sewing or buckling. Each angled strap forms an arch at an orientation angle (alpha) between 15° and 70°, with only one face contacting the head. These straps act as chords, connecting two points on the circular strap barrier's circumference without passing through the central intersection node, and intersect below the apex of the head (e.g., at the forehead) to form a fixed, non-adjustable net, as illustrated in FIGS. 6*a*-6*b*. This configuration defines net N2 for the present embodiment. Unlike traditional crossing straps 15 anchored at both ends to the helmet shell, the angled straps provide immediate tensile response to lateral impacts. FIG. 6*b* shows an exploded view, illustrating the single strap threaded through hangers and the angled straps' attachment. The net N2 provides energy absorption through strap and shell deformation, with hangers enabling net removability. Variations include elastic straps or alternative attachment methods (e.g., adhesives).

Figure 7:
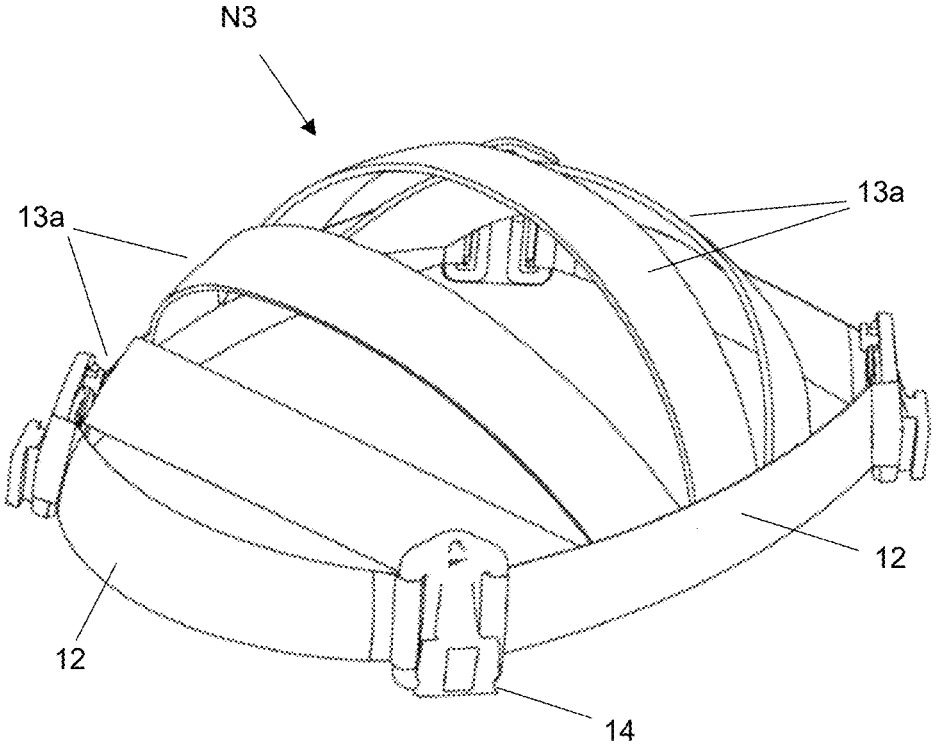
FIG. 7 shows an isometric view of a third embodiment of the helmet suspension assembly, illustrating a non-crossing arch configuration optimized for lateral impact resistance.

Embodiment 3: Circular Strap Barrier Arrangement with 4 Non-Crossing Angled Straps (FIG. 7)

This embodiment features a circular strap barrier 12 formed by multiple pliable straps, made of materials such as nylon or polyester, each approximately 2-3 cm wide. The circular strap barrier is connected via hangers 14 with lateral slots 14*a* and encircles the head below the apex of the head. Four angled straps 13*a*, composed of pliable materials (e.g., nylon or elastomers, 2-3 cm wide), are attached directly to the circular strap barrier using suitable means of attachment, such as sewing or buckling. Each angled strap forms an arch at an orientation angle (alpha) between 15° and 70°, with only one face contacting the head. These straps act as chords connecting two points on the circular strap barrier's circumference, without passing through the central intersection node. The angled straps are layered vertically at distinct heights and do not intersect with one another, collectively forming a fixed, non-adjustable net, as illustrated in FIG. 7. This configuration defines net N3 for the present embodiment. Unlike traditional crossing straps 15, the non-crossing angled straps provide immediate tensile response to lateral impacts. The net N3 enhances head retention and energy absorption through strap and shell deformation, with variations including elastic straps or alternative attachment methods (e.g., adhesives).

Figure 8A:
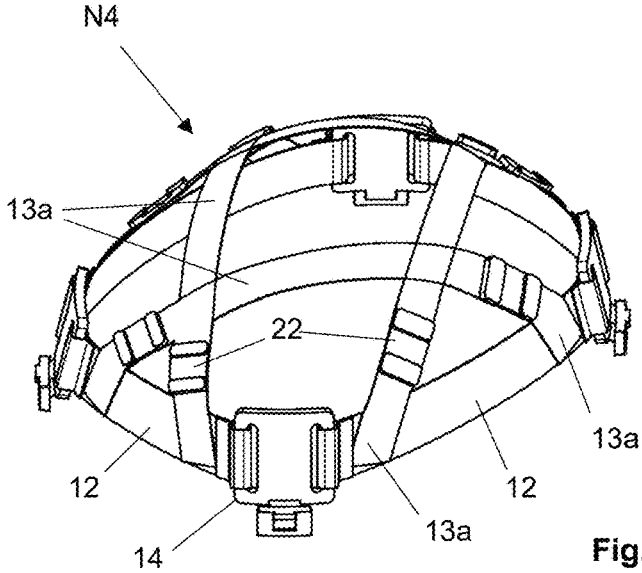
FIG. 8*a* shows an isometric view of a fourth embodiment of the helmet suspension assembly, illustrating a net configuration with eight elastomeric components integrated into angled strap assemblies via means of attachment, for enhanced tension-based impact absorption.
Figure 8B:
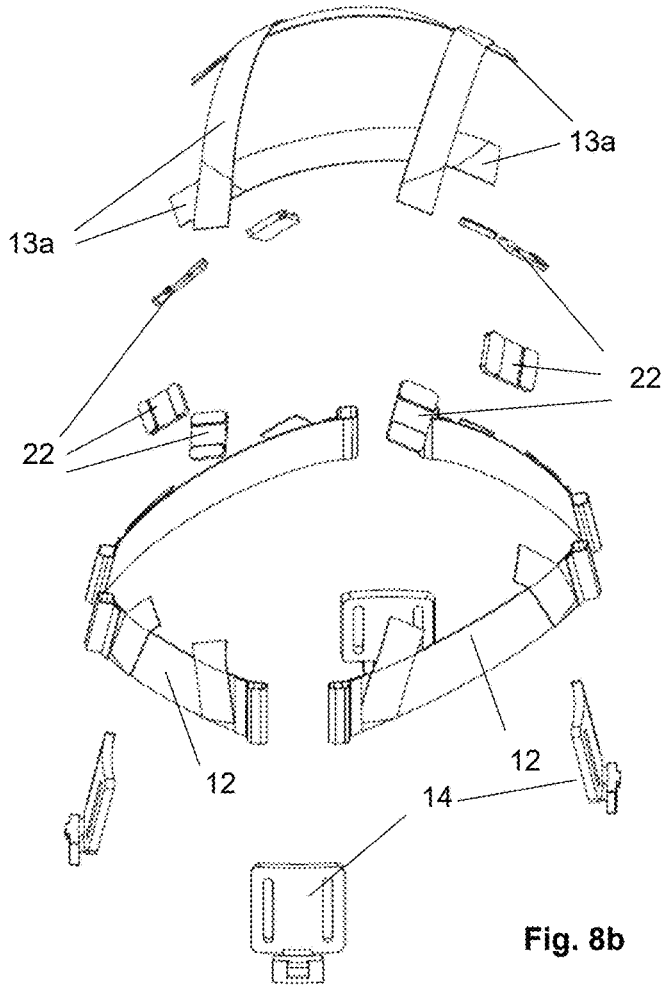
FIG. 8*b* shows an exploded isometric view of the helmet suspension assembly shown in FIG. 8*a*, illustrating the arrangement of components.

Embodiment 4: Angled Strap Suspension with 8 Elastomeric Components (FIGS. 8*a-b*)

This embodiment features an angled strap suspension comprising a circular strap barrier 12, formed by multiple pliable straps made of materials such as nylon or polyester, each approximately 2-3 cm wide. The circular strap barrier is connected via hangers 14 with lateral slots 14*a* and encircles the head below the apex of the head. Angled straps 13*a*, also made of pliable materials (e.g., nylon, 2-3 cm wide), include eight elastomeric components 22 (e.g., rubber or silicone strips, 1-2 cm wide), which are integrated into the straps by means of attachment such as sewing or overmolding. Each angled strap 13*a* forms an arch at an orientation angle (alpha) between 15° and 70°, with only one face contacting the head. The straps act as chords connecting two points on the circular strap barrier's circumference, without passing through the central intersection node, and intersect below the apex of the head (e.g., at the forehead) to form a fixed, non-adjustable net, as shown in FIGS. 8*a*-8*b*. This configuration defines net N4 for the present embodiment. Unlike traditional crossing straps 15, the angled straps provide immediate tensile response to lateral impacts. FIG. 8*b* shows an exploded view of the component arrangement. The elastomeric components 22 enhance energy dissipation through deformation, operating in tension during lateral impacts, complementing strap and shell deformation within the crush zone 19. Variations include different elastomeric materials (e.g., silicone, polyurethane) or attachment methods (e.g., adhesives).

Figure 9:
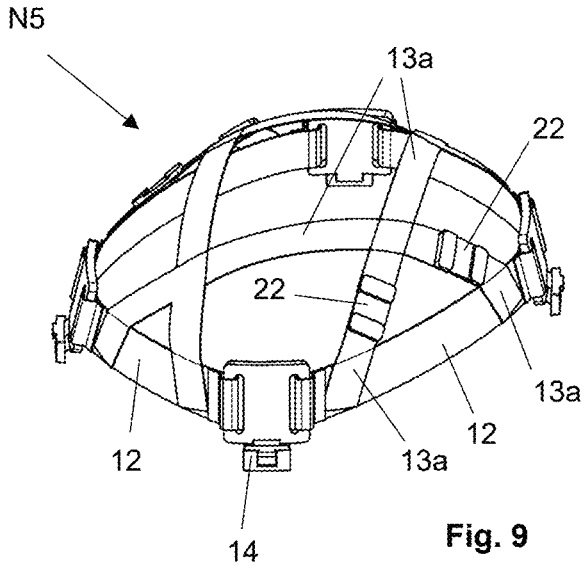
FIG. 9 shows an isometric view of a fifth embodiment of the helmet suspension assembly, illustrating a net configuration with four elastomeric components integrated into angled strap assemblies for enhanced tension-based impact absorption.

Embodiment 5: Angled Strap Suspension with 4 Elastomeric Components (FIG. 9)

This embodiment features an angled strap suspension comprising a circular strap barrier 12 formed by multiple pliable straps, made of materials such as nylon or polyester with a width of 2-3 cm, connected via hangers 14 with lateral slots 14*a* and encircling the head below the apex of the head. Angled straps 13*a*, made of pliable materials (e.g., nylon, 2-3 cm wide), include 4 elastomeric components 22 (e.g., rubber or silicone strips, 1-2 cm wide), integrated into the angled straps via means of attachment (e.g., sewing, overmolding). Each angled strap 13*a* forms an arch at a 15-70° orientation (alpha), with only one face contacting the head, acting as a chord connecting two points on the circular strap barrier's circumference without passing through the central intersection node. These angled straps intersect below the apex of the head (e.g., at the forehead), forming a fixed, non-adjustable net, as shown in FIG. 9. This configuration defines net N5 for the present embodiment. Unlike traditional crossing straps 15, the angled straps 13*a* provide immediate tensile response to lateral impacts. The elastomeric components 22 enhance energy dissipation through deformation, complementing strap and shell deformation within the crush zone (element 19). Variations include different elastomeric materials or attachment methods.

Figure 10:
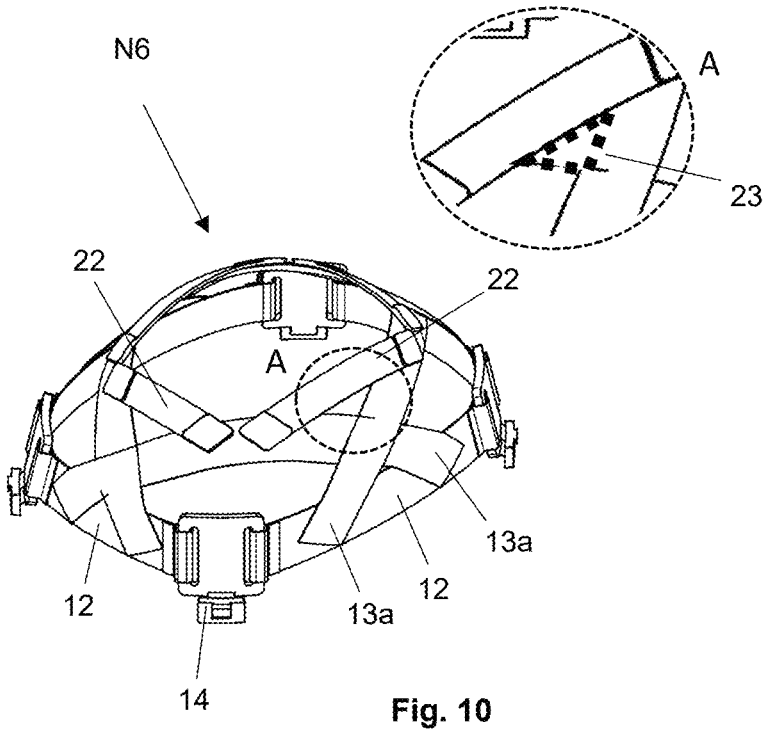
FIG. 10 shows an isometric view of a sixth embodiment of the helmet suspension assembly, illustrating a net configuration with elastomeric components configured as connecting straps for enhanced tension-based impact absorption.

Embodiment 6: Angled Strap Suspension with Elastomeric Components as Connecting Straps (FIG. 10)

This embodiment features an angled strap suspension comprising a circular strap barrier 12, formed by multiple pliable straps made of materials such as nylon or polyester, each approximately 2-3 cm wide. The circular strap barrier is connected via hangers 14 with lateral slots 14*a* and encircles the head below the apex of the head. Angled straps 13*a*, made of pliable materials (e.g., nylon, 2-3 cm wide), are attached directly to the circular strap barrier 12. Each strap forms an arch at an orientation angle (alpha) between 15° and 70°, with only one face contacting the head, and acts as a chord connecting two points on the circular strap barrier's circumference without passing through the central intersection node 17. The angled straps are arranged in a square-like configuration at the top of the head, with vertices directed toward the forehead, back, left ear, and right ear. Elastomeric components 22 (e.g., rubber or silicone, 1-2 cm wide) are configured as net-connecting straps 20aI, each extending between two angled straps to form the base of a triangular configuration located at the top of the head, as illustrated in FIG. 10. This configuration defines net N6 for the present embodiment. Unlike traditional crossing straps 15 anchored at both ends to the helmet shell, the net-connecting straps in net N6 stabilize the angled strap assembly, providing immediate tensile response to lateral impacts. The elastomeric components 22 restrict upward head movement during impacts, enhancing energy dissipation through deformation, complementing strap and shell deformation within the crush zone 19. Variations include different elastomeric materials or configurations (e.g., different strap counts).

Figure 11A:
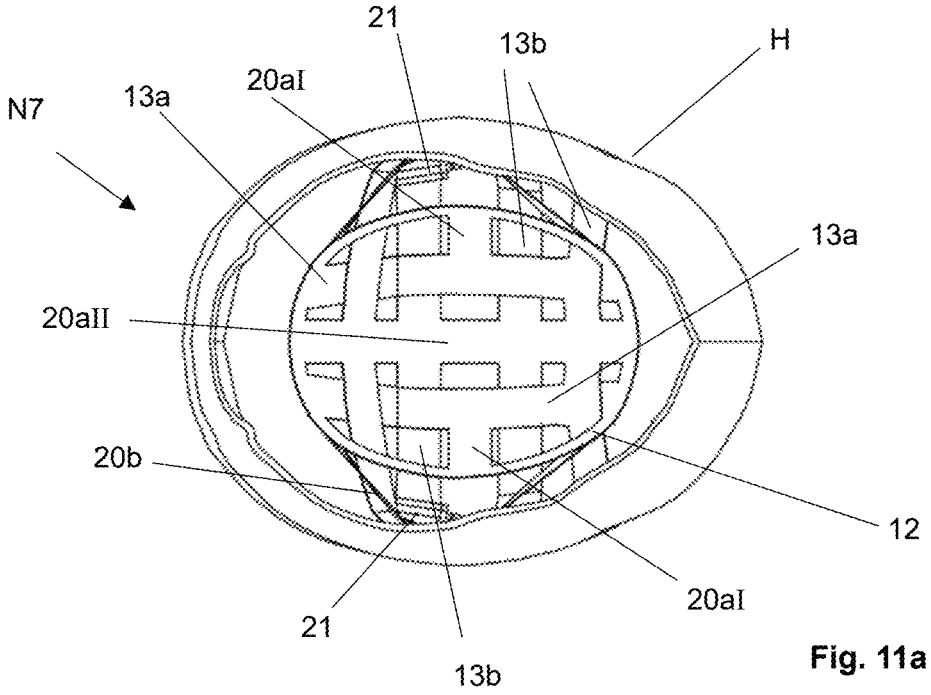
FIG. 11*a* shows a bottom view of a seventh embodiment of the helmet suspension assembly which relates to a motorcycle helmet with an angled strap suspension, illustrating a net configuration optimized for impact resistance.
Figure 11B:
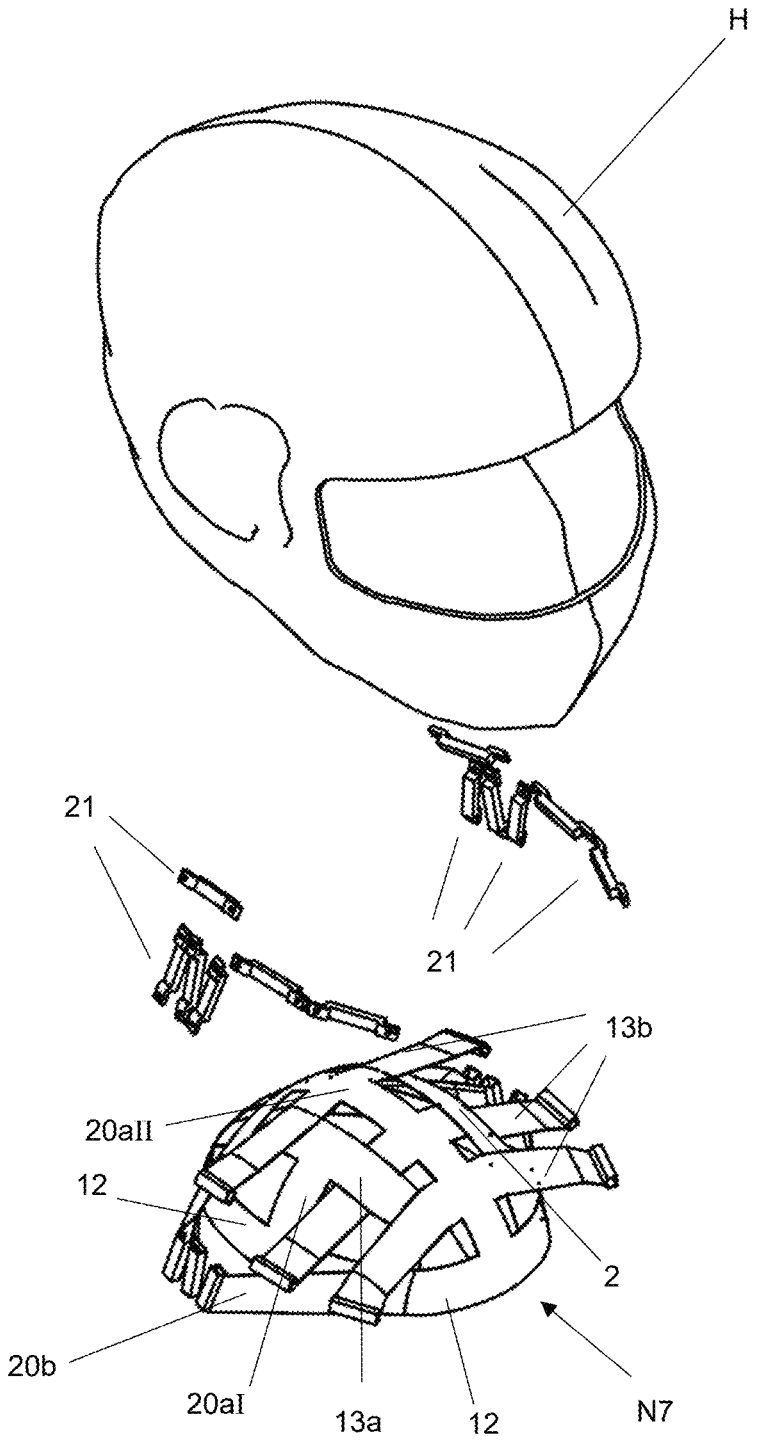
FIG. 11*b* shows an isometric exploded view of a motorcycle helmet with the angled strap suspension, illustrating the arrangement of components.
Figure 11C:
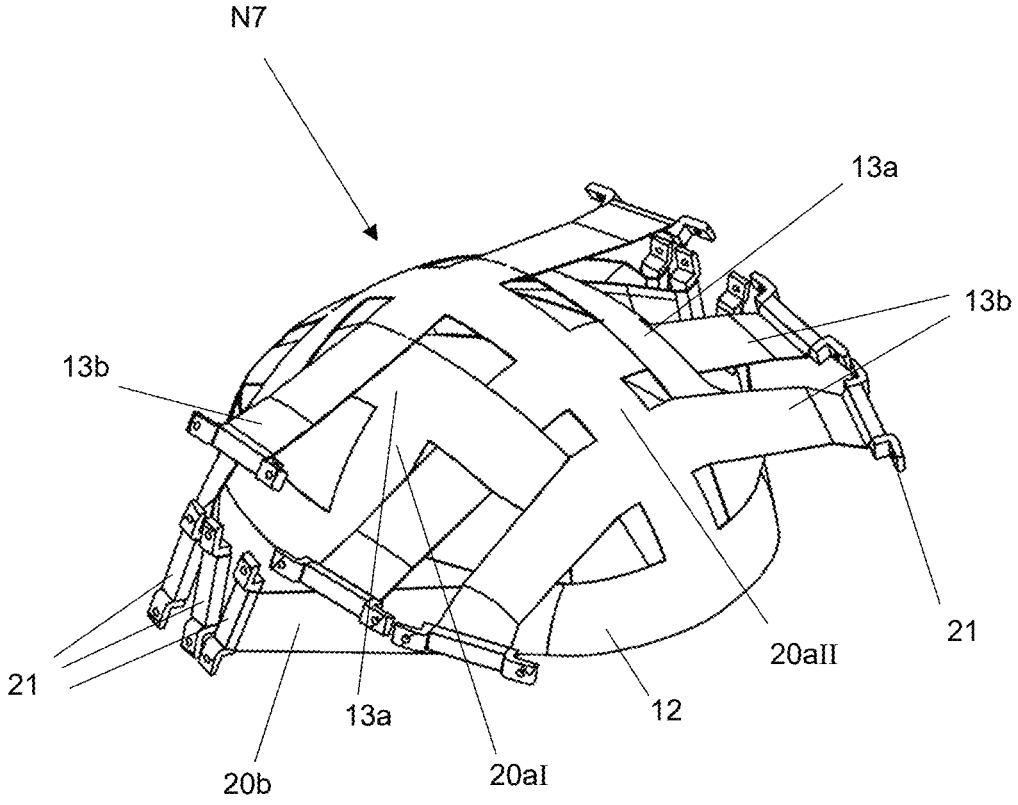
FIG. 11*c* shows an isometric view of the angled strap suspension for a motorcycle helmet, focusing on the suspension and attachment bars.

Embodiment 7: High Impact Angled Strap Suspension (FIGS. 11*a-c*)

This embodiment features a high-impact net N7 comprising a circular strap barrier 12 formed by a single pliable strap, made of materials such as nylon or polyester, approximately 2-3 cm wide. The circular strap barrier 12 encircles the head below the apex of the head, positioned at the nose/eyes in the front and at the ears on the sides. The net N7 includes the following components: (1) angled straps 13*b*, made of pliable materials (e.g., nylon or elastomers, 2-3 cm wide), connected to the helmet shell via attachment bars 21 or hangers 14, including four straps extending side-to-side (ear to ear); (2) angled straps 13*a*, made of pliable materials (e.g., nylon, 2-3 cm wide), connected directly to the circular strap barrier, including two straps extending front-to-back (from the nose/eyes to the back of the head); (3) net-connecting straps 20aI and 20aII, made of pliable materials (e.g., nylon or elastomers, 1-2 cm wide), with net-connecting straps 20aI comprising two short straps, each attaching a front-to-back angled strap 13*a* to the circular strap barrier, and net-connecting straps 20aII comprising a central strap extending front-to-back, connecting the four side-to-side angled straps 13*b* to the front and back of the circular strap barrier to form a spine-like structure; and (4) shell-connecting straps 20*b*, made of pliable materials (e.g., nylon, 1-2 cm wide), running parallel to the outer surface of the circular strap barrier and attached to the helmet shell via attachment bars 21 at one end only-unlike traditional crossing straps 15.

Each angled strap forms an arch at an orientation angle (alpha) between 15° and 70°, with only one face contacting the head, and acts as a chord connecting two points without passing through the central intersection node. These elements are interwoven to form a spherical net, as illustrated in FIGS. 11*a*-11*c*. The net N7 provides immediate tensile response to lateral and top-of-head impacts, enhancing head retention and energy absorption through deformation of the straps, helmet shell, and elastomeric components within the crush zone 19. Variations may include different strap materials, quantities, or attachment methods (e.g., direct stitching or buckling).

Operation of the Helmet Net

During an impact, the net, combining straps with distinct tensile strengths (e.g., elastic or textile), provides a tridimensional hold, stopping head movement toward the helmet shell, particularly for lateral impacts. Angled straps 13, 13*a*, 13*b*, acting as chords avoiding the central intersection node 17, ensure immediate tensile response, unlike conventional suspensions with node-crossing straps 15 that exhibit delayed tensile response due to slack or misalignment. This hold maximizes the crush zone 19 for energy absorption through shell deformation (primary), strap deformation (e.g., via elastic straps), optional elastomeric deformation 22, and optional impact-absorbing components, offering more engineering variables than conventional suspensions. Engineered angled crossings below the apex of the head (e.g., at the forehead) and the circular strap barrier 12, enhance stability, comfort, and ventilation without comfort pads. Hangers 14 enable net removability, and the net is compatible with retention systems.

Advantages of the Helmet Net

The subject disclosure simplifies construction, reduces weight, and enhances protection over conventional suspensions by using a fixed net with a circular strap barrier 12 and angled straps 13, 13*a*, 13*b* acting as chords, avoiding the central intersection node 17. The angled straps provide immediate tensile response to lateral impacts, unlike node-crossing straps 15 in M1 or modern 4-point/6-point suspensions, which exhibit delayed tensile response. The fixed net ensures superior head retention, and the combination of strap materials and elastomeric components 22 optimizes energy absorption. Increased contact points and lightweight straps improve comfort and ventilation without comfort pads, reducing cost. Hangers 14 enable removability, and compatibility with retention systems enhances practicality across all helmets with an outer shell.

The following is a detailed description of the drawings, which illustrate the embodiments of the disclosed helmet suspension system described above.

Figure 1A:
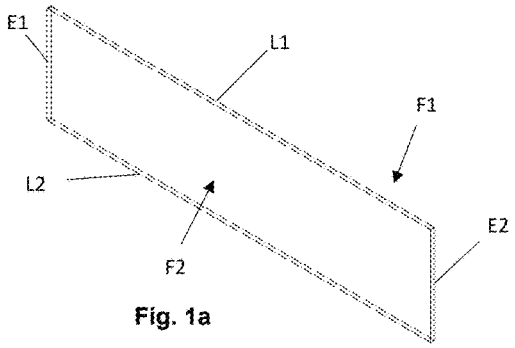
FIG. 1*a* shows an isometric view of a generic straight strap used in the helmet suspension assembly, illustrating the foundational structure of straps before they are configured for specific roles (e.g., circular strap barrier, angled strap, or traditional crossing strap).

FIG. 1*a* illustrates an isometric view of a generic straight strap used in the helmet suspension assembly, representing the foundational structure from which various strap configurations may be derived (e.g., circular strap barrier, angled strap, or traditional crossing strap). The strap comprises a longitudinal body with a first end E1 and a second end E2 positioned distally opposite each other. Two longitudinal edges L1, L2 are shown on opposite sides of the strap, each extending between E1 and E2. These edges define the boundaries of the strap's planar surfaces or faces, which include a first face F1 and a second face F2, the latter being inverse to the former.

Figure 1B:
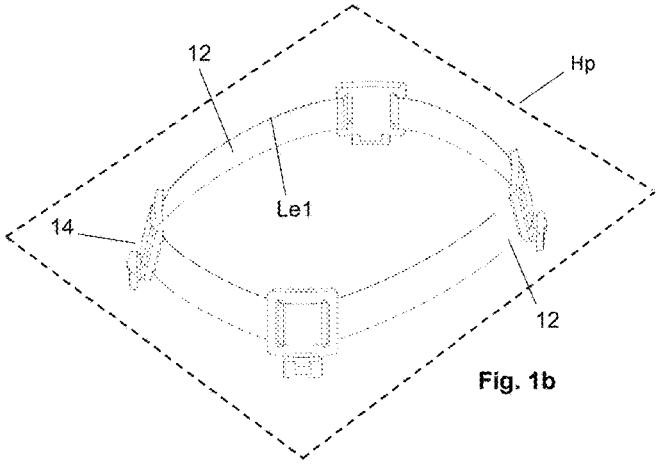
FIG. 1*b* shows an isometric view of a circular strap barrier formed by an arrangement of straps and hangers, illustrating the horizontal plane used as a reference for the angle of angled straps.

FIG. 1*b* shows an isometric view of a circular strap barrier formed by an arrangement of straps and hangers, illustrating the horizontal plane used as a reference for the angle of angled straps. Reference numeral 12 represents any strap within the arrangement of straps constituting the circular strap barrier. Reference numeral 14 is a hanger, forming part of the arrangement, connecting straps to each other and allowing the circular strap barrier to attach to a helmet shell and to other components. The longitudinal edge 12 of each strap 13 is labeled Le1, and the horizontal plane defined by the upper longitudinal edges Le1 of all straps in the circular strap barrier is labeled Hp, serving as the reference plane for angled strap orientation.

Figure 1C:
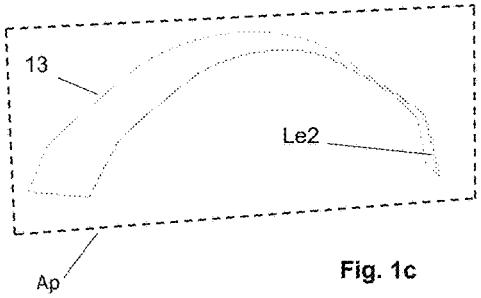
FIG. 1*c* shows an isometric view of an angled strap in the shape of an arch, illustrating a plane defined by one of its longitudinal edges labeled Le2.

FIG. 1*c* shows an isometric view of an angled strap in the shape of an arch, illustrating a plane defined by one of its longitudinal edges labeled Le2. The angled strap is labeled 13, with one longitudinal edge labeled Le2. The plane formed by the longitudinal edge Le2 of the angled strap 13*a* is labeled Ap, depicted as a vertical plane, critical for defining the angle of the angled strap relative to the horizontal plane of the circular strap barrier Hp.

Figure 1D:
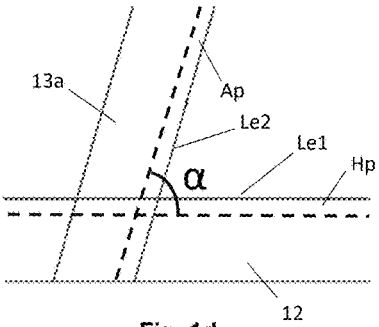
FIG. 1*d* shows a two-dimensional side view illustrating the angular relationship between a circular strap barrier strap (12) and an angled strap (13*a*).

FIG. 1*d* shows a two-dimensional side view illustrating the angular relationship between a circular strap barrier strap 12 and an angled strap 13*a*. Reference numeral 12 is a strap within the circular strap barrier, and 13*a* is an angled strap. The longitudinal edge of the circular strap barrier strap 12 is labeled Le1, with a dotted line representing the horizontal plane Hp drawn adjacent to Le1. The longitudinal edge of the angled strap 13*a* is labeled Le2, with a dotted line representing the plane Ap drawn adjacent to Le2. The angle between the planes Hp and Ap is labeled alpha (a), clarifying the engineered angle for tension-based energy absorption.

Figure 1E:
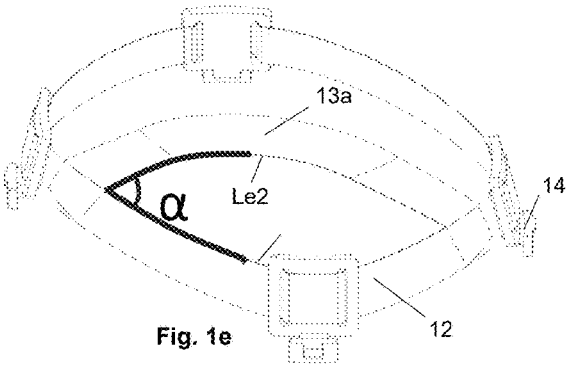
FIG. 1*e* shows an isometric view illustrating the angular relationship between an angled strap (13*a*) and the circular strap barrier (12).

FIG. 1*e* shows an isometric view illustrating the angular relationship between an angled strap 13*a* and the circular strap barrier 12. Reference numeral 12 is a strap within the circular strap barrier arrangement, reference numeral 13*a* is an angled strap forming an arch, and reference numeral 14 is a hanger connecting the angled strap to the circular strap barrier. The longitudinal edge of the circular strap barrier 12 is labeled Le1, and the longitudinal edge of the angled strap 13*a* is labeled Le2. The angle formed between the plane (Ap) defined by the longitudinal edge Le2 of the angled strap and the horizontal plane (Hp) of the circular strap barrier is labeled alpha (a), representing an engineered angle (e.g., 15-70°) optimized for the angled strap's tension-based energy absorption.

Figure 2A:
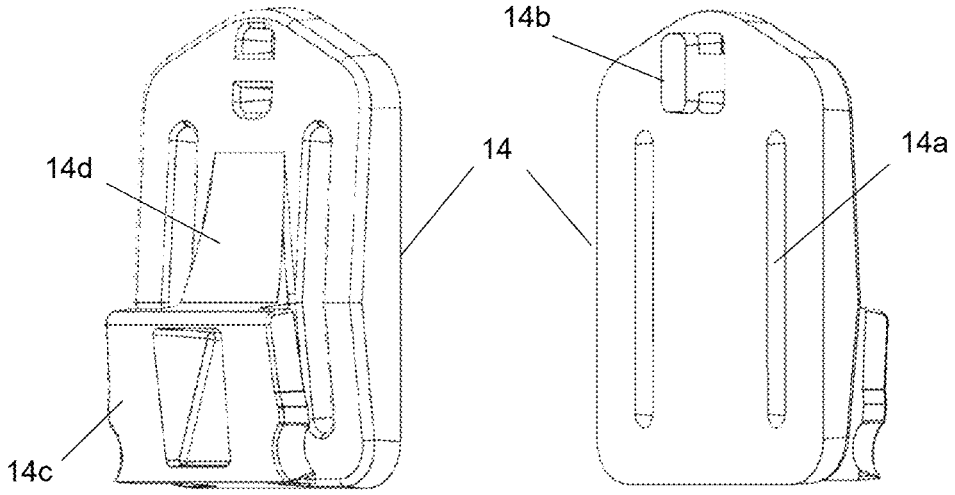
FIG. 2*a* shows an isometric view of a hanger (14), depicted as a rectangular cuboid with longer edges oriented vertically and shorter edges horizontally, showing both front and back sides in two sub-images.

FIG. 2*a* shows an isometric view of a hanger 14, depicted as a rectangular cuboid with longer edges oriented vertically and shorter edges horizontally, showing both front and back sides in two sub-images. The hanger is labeled 14. The front side includes a helmet attachment feature, labeled 14*c*, configured as an attachment feature such as a protruding connector that engages a corresponding slot in a helmet shell labeled 14*d*, enabling secure and removable attachment while maintaining separation between the circular strap barrier and the shell. The back side includes a headband attachment feature, 14*b*, configured as an attachment feature such as a protruding connector to secure a size-fitting or head-fitting headband to the inner side of the circular strap barrier. The actual geometry of features 14*b*, 14*c* and 14*d* may vary depending on the helmet shell or headband used. Two slots, each labeled 14*a*, traverse the hanger at opposite ends, configured to hold or guide straps 13 to interconnect and form the circular strap barrier arrangement or to thread a single strap forming the circular strap barrier, similar to an adjustment buckle.

Figure 2B:
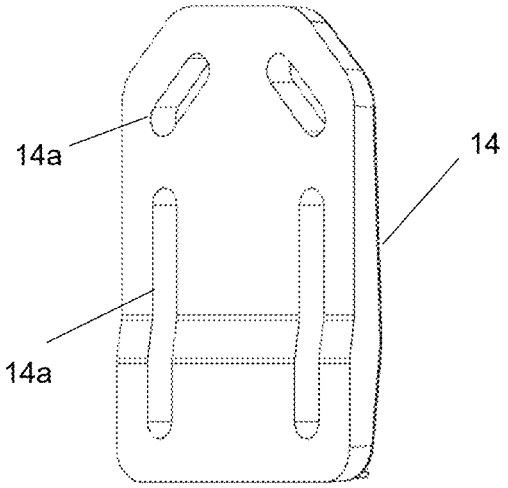
FIG. 2*b* shows an isometric view of a hanger, labeled 14, with multiple slots for attaching angled straps to the circular strap barrier.

FIG. 2*b* shows an isometric view of a hanger, labeled 14, with multiple slots for attaching angled straps to the circular strap barrier. The hanger includes four slots, each labeled 14*a*, with two slots located in the upper portion of the cuboid, configured to hold or guide angled straps 13*a*, and two slots on each side of the hanger, configured to hold or guide circular strap barrier straps 12 to construct the circular strap barrier. Slot sizes and shapes are general depictions, with geometries varying by helmet or suspension design. The helmet attachment feature 14*c* and headband attachment feature 14*b*, consistent with FIG. 2*a*, are general depictions, with geometries varying by helmet or headband.

Figure 3A:
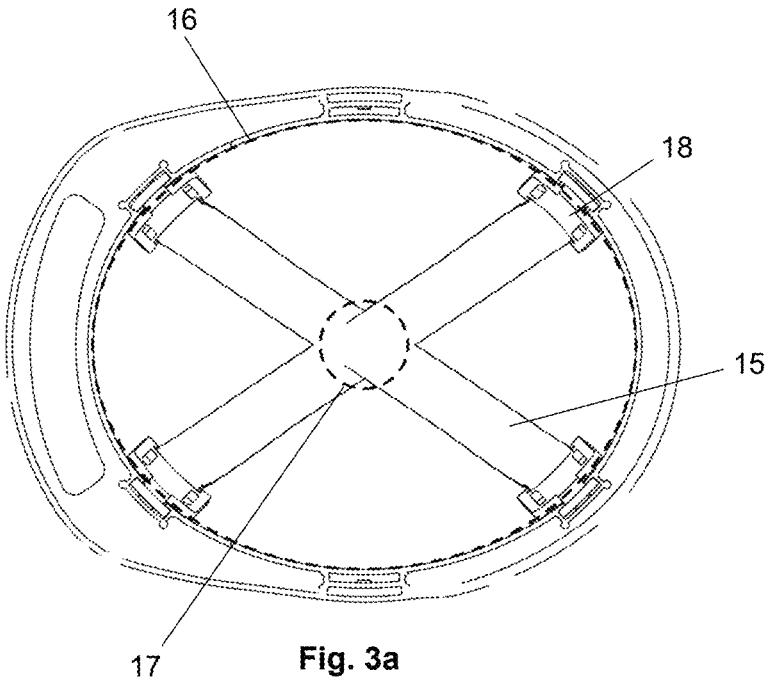
FIG. 3*a* shows a bottom view of a helmet shell, illustrating the inner circumference and the central intersection node, contrasted with a conventional four-point strap suspension.

FIG. 3*a* shows a bottom view of a helmet shell, illustrating the inner circumference and the central intersection node, contrasted with a conventional four-point strap suspension. The inner circumference of the helmet shell is depicted as an elliptical shape, labeled 16, representing a planar area at the base of the shell, approximating the largest possible ellipse within the helmet's inner circumference to identify the region where conventional straps typically intersect. The geometric center of this elliptical plane defines a circle with a diameter of approximately 1-2 inches, representing the base of the central intersection node 17. A conventional four-point strap suspension is shown, with two straps, each labeled 15, intersecting at the central intersection node 17, depicted as a circular area from this bottom perspective, illustrating how prior art suspensions cross this region, unlike the present invention's angled straps 13 that avoid it. Traditional hangers, labeled 18, are used to attach the conventional suspension to the helmet shell, distinguished from the subject disclosure's hangers 14 that include lateral slots 14*a* for constructing or guiding the circular strap barrier.

Figure 3B:
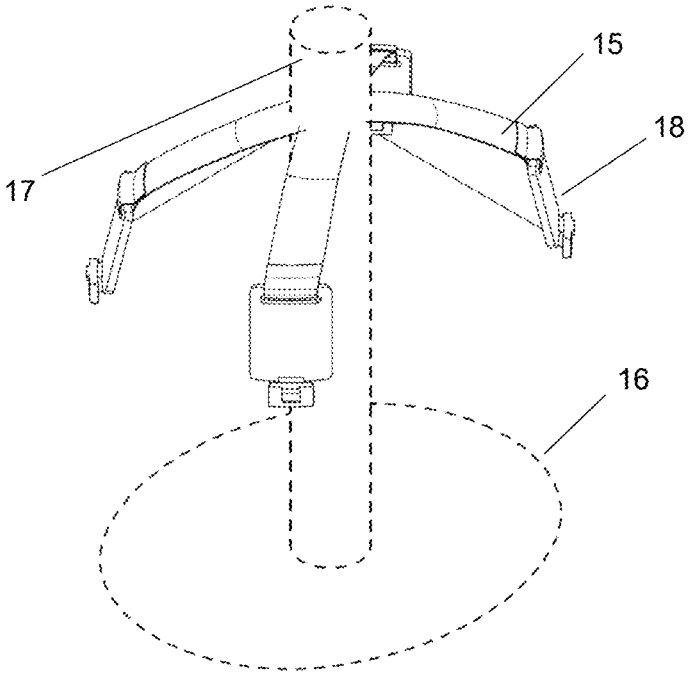
FIG. 3*b* shows an isometric view of the central intersection node and a conventional four-point strap suspension, with the helmet shell omitted for clarity.

FIG. 3*b* shows an isometric view of the central intersection node and a conventional four-point strap suspension, with the helmet shell omitted for clarity. The central intersection node, labeled 17, is depicted as a cylindrical volume extruded from a 1-2 inch diameter circle at the geometric center of the elliptical plane 16 at the base of the helmet shell to the top of the inner surface of the shell, approximating the region where conventional strap suspensions intersect. Two conventional suspension straps, each labeled 15, intersect at the central intersection node 17, forming an "X" configuration typical of a four-point suspension, highlighting the contrast with the present invention's angled straps 13 that avoid this cylindrical volume. Traditional hangers 18, anchor the conventional suspension, distinguished from the invention's hangers 14. The elliptical plane 16 represents the base plane from which the central intersection node cylinder is extruded.

Figure 4A:
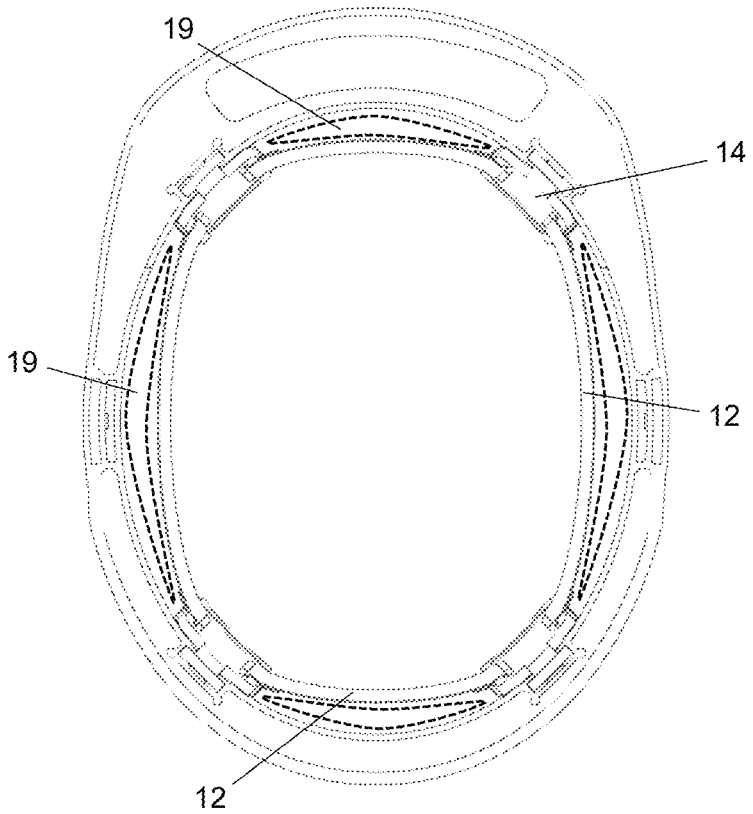
FIG. 4*a* shows a bottom view of an industrial helmet shell, illustrating the crush zone as a reference concept for the open space between the circular strap barrier and the helmet's inner circumference.

FIG. 4*a* shows a bottom view of an industrial helmet shell, illustrating the crush zone as a reference concept for the open space between the circular strap barrier and the helmet's inner circumference. Reference numeral 12 represents straps forming the circular strap barrier, and reference numeral 14 represents hangers attaching the straps to the helmet shell. The crush zone, labeled 19, is depicted as a dotted outline representing the lateral open space between the circular strap barrier and the helmet's inner circumference, illustrating the concept of a lateral crush zone that facilitates energy absorption during impact. The crush zone 19 is a general depiction, with its size and shape varying by helmet and suspension design and represents only a two-dimensional view of the three-dimensional open space between the head and the suspension.

Figure 4B:
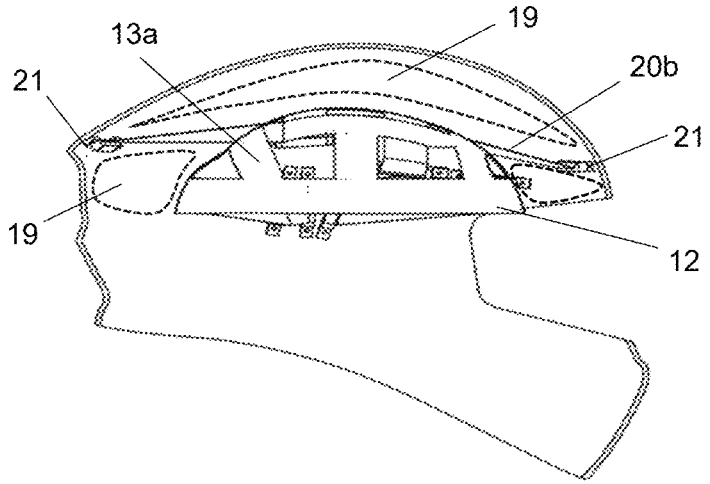
FIG. 4*b* shows a two-dimensional side view of a motorcycle helmet shell with the invented suspension system, illustrating the crush zone as a reference concept for the open space within the helmet.

FIG. 4*b* shows a two-dimensional side view of a motorcycle helmet shell with the invented suspension system, illustrating the crush zone as a reference concept for the open space within the helmet. Reference numeral 12 represents straps forming the circular strap barrier, reference numeral 13*a* represents angled straps, reference numeral 20*b* represents a connecting strap (with one or two straps labeled to maintain clarity), and reference numeral 21 represents attachment bars connecting the suspension to the helmet shell. The crush zone 19 is depicted as a dotted outline representing the open space above, in front of, and behind the head within the helmet, illustrating the concept of a three-dimensional crush zone that facilitates energy absorption during impact. The connecting strap 20*b* extends from the circular strap barrier to the helmet shell, attached to the circular strap barrier and to the attachment bars 21 via means of attachment, contributing to the crush zone 19 by maintaining separation between the suspension and the shell in a manner distinct from the hangers' 14 separation. The crush zone 19 is a general depiction, with its size and shape varying by helmet and suspension design and is shown in a motorcycle helmet to emphasize its applicability across different helmet types and the larger, more visible crush zone in such designs.

FIG. 5*a* illustrates an isometric view of a helmet suspension assembly (Embodiment 1), depicting net configuration N1, which is optimized for lateral impact resistance. Reference numeral 12 denotes multiple pliable straps that form the circular strap barrier, encircling the head below the apex of the head. Reference numeral 14 represents hangers that interconnect the straps and secure the circular strap barrier 12 to the helmet shell. Reference numeral 13*a* identifies angled straps that are attached directly to the circular strap barrier 12. These angled straps form arches with only one face contacting the head and intersect below the central intersection node (e.g., at the forehead), thereby creating a fixed, non-adjustable net structure.

FIG. 5*b* illustrates an exploded isometric view of the helmet suspension assembly corresponding to net configuration N1 shown in FIG. 5*a*, highlighting the arrangement of individual components. Reference numeral 12 denotes multiple pliable straps interconnected via hangers 14 to form the circular strap barrier, which encircles the head below the apex of the head. Hangers 14, equipped with slots (14*a*), serve to interconnect the straps and secure the suspension assembly to the helmet shell. Reference numeral 13*a* represents angled straps that are attached directly to the circular strap barrier 12. These angled straps form arches with only one face in contact with the head and intersect below the central intersection node (e.g., at the forehead), contributing to a fixed, non-adjustable net configuration.

FIG. 6*a* illustrates an isometric view of a helmet suspension assembly (Embodiment 2), showing net configuration N2, which is optimized for lateral impact resistance through the use of a single strap forming the circular strap barrier 12. The circular strap barrier 12 is formed by a single pliable strap threaded through a series of hangers 14, which are configured as buckle-like guides with slots (14*a*). These hangers secure the strap in position, allowing it to encircle the head below the apex of the head and affix the suspension assembly to the helmet shell. Reference numeral 13*a* represents angled straps, attached directly to the circular strap barrier 12, forming arches with only one face contacting the head and intersecting below the central intersection node (e.g., at the forehead) to create a fixed, non-adjustable net.

FIG. 6*b* illustrates an exploded isometric view of the helmet suspension assembly corresponding to net configuration N2 shown in FIG. 6*a*, highlighting the arrangement of its components. A single pliable strap, threaded through hangers 14, forms the circular strap barrier 12, which encircles the head below the apex of the head. Reference numeral 14 denotes hangers configured as buckle-like guides with slots (14*a*) that direct the strap along the desired path and secure the suspension to the helmet shell. Reference numeral 13*a* identifies angled straps attached directly to the circular strap barrier 12. These angled straps form arches with only one face in contact with the head and intersect below the central intersection node (e.g., at the forehead), thereby forming a fixed, non-adjustable net structure.

FIG. 7 illustrates an isometric view of a helmet suspension assembly corresponding to net configuration N3 (Embodiment 3), which features a non-crossing arch configuration optimized for lateral impact resistance. Reference numeral 12 denotes multiple pliable straps forming the circular strap barrier, which encircles the head below the apex of the head. Reference numeral 14 identifies hangers that interconnect the straps to form the circular strap barrier 12 and attach the net N3 to the helmet shell. Reference numeral 13*a* represents angled straps that are layered vertically at distinct heights relative to the circular strap barrier 12. These angled straps form arches with only one face in contact with the head and are configured to avoid intersecting with one another or with the central intersection node 17, thereby contributing to a fixed, non-adjustable net structure.

FIG. 8*a* shows an isometric view of a helmet suspension assembly corresponding to net configuration N4 (Embodiment 4), illustrating a net structure incorporating eight elastomeric components 22 integrated into angled strap assemblies for enhanced tension-based impact absorption. Reference numeral 12 denotes multiple straps forming the circular strap barrier, which encircles the head below the apex of the head. Reference numeral 14 identifies hangers that connect the multiple straps to form the circular strap barrier and secure the suspension assembly to the helmet shell. Reference numeral 13 represents angled strap assemblies, each comprising one or more straps and elastomeric components 22, attached to the circular strap barrier 12. These angled strap assemblies form arches with only one face in contact with the head and intersect below the central intersection node 17, such as at the forehead. Reference numeral 22 identifies elastomeric components, such as strips of elastomeric or elastic material, integrated into each angled strap assembly 13 by attaching strap material to each end of the elastomeric component. These components are dimensioned similarly to the straps to maintain visual and structural consistency and are configured to operate in tension to enhance energy absorption and dissipate impact forces. The illustrated configuration is exemplary, and variations in the quantity and arrangement of straps and elastomeric components are possible, as shown in subsequent figures.

FIG. 8*b* shows an exploded isometric view of the helmet suspension assembly corresponding to net configuration N4 (Embodiment 4) shown in FIG. 8*a*, illustrating the arrangement of components. Reference numeral 12 denotes multiple straps that interconnect via hangers to form the circular strap barrier, which encircles the head below the apex of the head. Reference numeral 14 identifies hangers with slots 14*a* configured to guide and interconnect the multiple straps 12 and attach the suspension to the helmet shell. Reference numeral 13 represents angled strap assemblies, each comprising one or more straps and elastomeric components 22, attached to the circular strap barrier 12. These assemblies form arches with only one face in contact with the head and intersect below the central intersection node, such as at the forehead. Reference numeral 22 denotes elastomeric components, such as strips of elastomeric or elastic material, integrated into each angled strap assembly 13 by attaching strap material to each end of the elastomeric component to facilitate connection to the circular strap barrier. The elastomeric components 22 are dimensioned similarly to the straps for consistent appearance and are configured to operate in tension to enhance energy absorption and dissipate impact forces. The configuration shown is illustrative, and the order and quantity of straps and elastomeric components may vary in other embodiments, as presented in subsequent figures.

FIG. 9 shows an isometric view of a helmet suspension assembly corresponding to net configuration N5 (Embodiment 5), illustrating a net configuration with four elastomeric components integrated into angled strap assemblies to enhance tension-based impact absorption. Reference numeral 12 denotes multiple straps forming the circular strap barrier, which encircles the head below the apex of the head. Reference numeral 14 represents hangers that interconnect the multiple straps 12 to form the circular strap barrier and attach the suspension to the helmet shell. Reference numeral 13*a* identifies angled strap assemblies, each comprising one or more straps and an elastomeric component 22, attached to the circular strap barrier 12. These assemblies form arches with only one face contacting the head and intersect below the central intersection node, such as at the forehead. Reference numeral 22 denotes elastomeric components, such as strips of elastomeric or elastic material, integrated into each angled strap assembly 13*a* by attaching strap material to one end of the elastomeric component to enable connection to the circular strap barrier. The elastomeric components are sized similarly to the straps for consistent appearance and are configured to operate in tension to enhance energy absorption and dissipate impact forces during impact. The configuration shown is illustrative, and the order and quantity of straps and elastomeric components may vary in other embodiments.

FIG. 10 shows an isometric view of a helmet suspension assembly corresponding to net configuration N6 (Embodiment 6), illustrating a net configuration with elastomeric components configured as connecting straps to enhance tension-based impact absorption. Reference numeral 12 denotes multiple straps forming the circular strap barrier, which encircles the head below the apex of the head. Reference numeral 14 represents hangers that connect the multiple straps 12 to form the circular strap barrier and attach the suspension to the helmet shell. Reference numeral 13*a* identifies angled straps, attached directly to the circular strap barrier 12, forming arches with only one face contacting the head and intersecting below the central intersection node, such as at the forehead. The angled straps are arranged in a square-like configuration at the top of the head, with vertices oriented toward the forehead, back of the head, left ear, and right ear relative to a wearer's head. Reference numeral 22 denotes elastomeric components, such as strips of elastomeric or elastic material, configured as connecting straps, each extending between two angled straps 13*a* to form the base of a triangular configuration in which the angled straps form the sides. These triangular formations are located at the top of the head. Reference numeral 23 indicates a dotted triangular outline that visually illustrates the triangular configuration formed by each elastomeric component and the two angled straps. The elastomeric components 22 are configured to restrict upward head movement during an impact event by operating in tension, resisting the strap net's tendency to open and the wearer's head from pushing through the angled straps, while absorbing energy through deformation.

FIG. 11*a* shows a bottom view of a motorcycle helmet H with an angled strap suspension corresponding to net configuration N7 (Embodiment 7), illustrating a configuration optimized for impact resistance. Reference numeral 12 denotes a single strap forming the circular strap barrier, which encircles the head below the apex of the head and is attached to the helmet H via connecting straps 20*b* and attachment bars 21. Reference numeral 21 indicates attachment bars configured to connect the circular strap barrier 12 to the helmet shell H, thereby securing the suspension system.

Reference numeral 13 denotes angled strap assemblies, which include a first set of angled straps 13*a* connected directly to the circular strap barrier 12 and second set of angled straps 13*b* connected to the helmet shell via attachment bars 21 and to the circular strap barrier via connecting straps 20aII. These angled strap assemblies form arches with only one face contacting the head and include four straps extending side to side (from ear to ear) and two straps extending front to back (from the nose or eyes to the back of the head), interwoven to form a spherical net. The angled strap assemblies 13*a* and 13*b* function as chords connecting two points on the circumference of the circular strap barrier (straps 13*a*) or the inner circumference of the helmet shell (straps 13*b*) without crossing through the central point, thereby enhancing tensile resistance to lateral impacts. Reference numeral 20aI represents two short connecting straps, each attaching a front-to-back angled strap 13*a* to the side of the circular strap barrier 12. Reference numeral 20aII denotes a central connecting strap extending front to back, connecting the four side-to-side angled straps 13*b* between them and to the front and back portions of the circular strap barrier 12, forming a spine-like structure that reinforces the net. Reference numeral 20*b* indicates connecting straps running parallel to the outer surface of the circular strap barrier, attaching it to the sides of the helmet shell via attachment bars 21 and means of attachment, thereby enhancing lateral stability.

FIG. 11*b* shows an isometric exploded view of a motorcycle helmet H with the angled strap suspension corresponding to net configuration N7 (Embodiment 7), illustrating the arrangement of components. Reference numeral 12 denotes a single strap threaded to form the circular strap barrier, which encircles the head below the central intersection node (front at nose/eyes, sides at ears) and is attached to the helmet H via connecting straps 20*b* through attachment bars 21. Reference numeral 21 represents attachment bars, configured as buckle-like guides, that connect the circular strap barrier 12 to the helmet shell H via connecting straps 20*b*, thereby securing the suspension assembly. Reference numeral 13 identifies angled strap assemblies, comprising a first set of angled straps 13*a* connected directly to the circular strap barrier and a second set of angled straps 13*b* connected to the helmet shell via attachment bars 21. These angled straps form arches with only one face contacting the head and include four straps extending side to side (from ear to ear) and two straps extending front to back (from nose/eyes to the back of the head), interwoven to form a spherical net. The angled strap assemblies 13*a* and 13*b* act as chords, connecting two points on the circumference of the circular strap barrier or the inner circumference of the helmet shell without passing through the center, thereby enhancing tensile resistance to lateral and top-of-head impacts. Reference numeral 20aI represents two short connecting straps, each attaching a front-to-back angled strap 13*a* to the circular strap barrier. Reference numeral 20aII denotes a central connecting strap extending front to back, connecting the four side-to-side angled straps 13*b* between them and to the front and back portions of the circular strap barrier, forming a spine-like structure reinforcing the net. Reference numeral 20*b* identifies connecting straps running parallel to the outer surface of the circular strap barrier, attaching it to the sides of the helmet shell via attachment bars 21 and other means of attachment, enhancing lateral stability. The exploded view further highlights the arched shape of the straps and their interconnections.

FIG. 11*c* shows an isometric view of the angled strap suspension N7 (Embodiment 7) for a motorcycle helmet, focusing on the suspension and attachment bars. Reference numeral 12 denotes a single strap forming the circular strap barrier, which encircles the head below the central apex of the head and is attached to the helmet H via connecting straps 20*b* through attachment bars 21. Reference numeral 21 represents attachment bars, configured as buckle-like guides that connect the circular strap barrier 12 to the helmet shell H, thereby securing the suspension. Reference numeral 13 identifies angled strap assemblies, comprising a first set of angled straps 13*a* connected directly to the circular strap barrier and a second set of angled straps 13*b* connected to the helmet shell via attachment bars 21. These angled straps form arches with only one face contacting the head and include four straps extending side to side (from ear to ear) and two straps extending front to back (from nose/eyes to the back of the head), interwoven to form a spherical net. The angled strap assemblies 13*a* and 13*b* act as chords, connecting two points on the circumference of the circular strap barrier (straps 13*a*) or the inner circumference of the helmet shell (straps 13*b*) without passing through the center, thereby enhancing tensile resistance to top-of-head and lateral impacts. Reference numeral 20aI denotes two short connecting straps, each attaching a front-to-back angled strap 13*a* to the circular strap barrier 12. Reference numeral 20aII identifies a central connecting strap extending front to back, connecting the four side-to-side angled straps 13*b* between them and to the front and back of the circular strap barrier 12 (on opposite sides), forming a spine-like structure that reinforces the net. Reference numeral 20*b* represents connecting straps running parallel to the outer surface of the circular strap barrier 12, attaching the circular strap barrier to the sides of the helmet shell via attachment bars 21 and other means of attachment, enhancing lateral stability. This figure provides a close-up view of the net's detailed structure.

The embodiments described herein are presented by way of example and are not intended to be limiting. It will be understood by those skilled in the art that various modifications, variations, and equivalents may be made without departing from the scope and spirit of the invention as defined by the appended claims. Features described in connection with any particular embodiment may be combined with those of other embodiments without departing from the scope of the disclosure.

All of the patents, patent applications, and publications recited herein, and in the Declaration attached hereto, if any, are hereby incorporated by reference as if set forth in their entirety herein. All, or substantially all, the components disclosed in such patents may be used in the embodiments of the subject disclosure, as well as equivalents thereof. The details in the patents, patent applications, and publications incorporated by reference herein may be considered to be incorporable at applicant's option, into the claims during prosecution as further limitations in the claims to patentable distinguish any amended claims from any applied prior art.

What is claimed is:

1. A multidirectional protection net for a helmet, comprising:

a circular strap barrier (12) formed by at least one pliable strap, wherein the circular strap barrier (12) is configured to be attached to a helmet shell and to encircle a wearer's head below an apex of the wearer's head;

a plurality of angled straps (13*a*) each having a first face and a second face inverse to the first face, wherein each angled strap (13*a*) configured to form an arch with only one face contacting the wearer's head, wherein each angled strap (13*a*) acts as a chord connecting two points on a circumference of the circular strap barrier's (12) without passing through a central intersection node (17), and wherein each angled strap (13*a*) is oriented at an angle of 15-70° (alpha) relative to a horizontal plane (Hp) defined by a longitudinal edge (Le1) of the circular strap barrier (12);

wherein the central intersection node (17) is defined as a cylindrical volume extruded from a 1-2-inch diameter circle at a geometric center, and perpendicular to, of a horizontal elliptical plane (16) within an inner circumference of the helmet shell;

wherein the circular strap barrier (12) and the angled straps (13*a*) are configured to cooperatively provide a tridimensional hold that restricts head movement relative to the helmet shell during impacts by providing an immediate tensile response to enhance energy absorption through deformation of the straps and deformation of the helmet shell.

2. The multidirectional protection net of claim 1, wherein the plurality of angled straps (13*a*) is connected to the circular strap barrier (12) via means of attachment.

3. The multidirectional protection net of claim 1, wherein the circular strap barrier (12) includes one or more hangers (14) having lateral slots (14*a*) configured to (i) connect multiple pliable straps or thread a single pliable strap to form the circular strap barrier (12), or (ii) attach the angled straps (13*a*) to the circular strap barrier (12), the hangers (14) being further configured to enable removability of the circular strap barrier (12) from the helmet shell.

4. The multidirectional protection net of claim 3, further comprising one or more impact-absorbing components attached to one or more of the hangers (14), the impact-absorbing components being configured to deform upon impact to dissipate energy.

5. The multidirectional protection net of claim 1, further comprising elastomeric components (22) integrated with the angled straps (13*a*) and functioning as connecting straps, wherein the elastomeric components (22) are formed of an elastic material and are secured to the angled straps (13*a*) by attachment means.

6. The multidirectional protection net of claim 1, wherein the angled straps (13*a*) comprise a combination of elastic straps and textile straps with distinct tensile strengths, forming engineered angled crossings below the apex of the head to optimize energy dissipation and head retention.

7. The multidirectional protection net of claim 1, further comprising one or more impact-absorbing components attached to one or more of the angled straps (13*a*), the impact-absorbing components being configured to deform upon impact to dissipate energy.

8. The multidirectional protection net of claim 1, wherein the circular strap barrier (12) is adapted for integration with helmet retention systems, including ratchet headbands or chin straps, configured to secure the helmet to the wearer's head while enhancing ventilation and comfort without requiring comfort pads.

9. The multidirectional protection net of claim 1, wherein the one or more angled straps (13*a*) comprise one or more elastomeric components.

* * * * *